US005345050A

United States Patent [19]

Branch et al.

[11] Patent Number: 5,345,050

[45] Date of Patent: Sep. 6, 1994

[54] SWITCH ACTUATING ASSEMBLY

[75] Inventors: Matthew G. Branch, Peoria; Chris E. Willey, Washington, both of Ill.

[73] Assignee: Caterpillar Inc., Peoria, Ill.

[21] Appl. No.: 69,330

[22] Filed: Jun. 1, 1993

[51] Int. Cl.[5] ..... H01H 3/12

[52] U.S. Cl. ..... 200/341; 200/329; 200/345; 200/538; 74/527; 74/553

[58] Field of Search ..... 200/329, 43.13, 47, 200/519, 537, 538, 539, 542, 345, 341; 74/527, 553, 556

[56] References Cited

U.S. PATENT DOCUMENTS

| | | | |
|---|---|---|---|
| 626,919 | 6/1899 | Medary | 200/539 |
| 1,439,839 | 12/1922 | Ragenovich | 200/539 |
| 1,826,105 | 10/1931 | Veale | 200/542 |
| 2,203,949 | 6/1940 | Edwards | 200/43.13 X |
| 2,305,603 | 12/1942 | Cadman | 200/52 |
| 2,491,315 | 12/1949 | Johnson | 74/527 |
| 2,496,092 | 1/1950 | Hinds | 200/542 |
| 2,638,015 | 5/1953 | Schoelles | 74/503 |
| 2,639,338 | 5/1953 | Kwasniewski | 200/5 |
| 2,935,894 | 5/1960 | Coronado-Arce | 74/503 |
| 3,244,015 | 4/1966 | Parris, Jr. | 74/107 |
| 3,253,111 | 5/1966 | Winter et al. | 200/167 |
| 3,414,693 | 12/1968 | Watson et al. | 200/47 |
| 3,699,283 | 10/1972 | Ustin | 200/47 |
| 3,959,614 | 5/1976 | Graninger | 200/47 |
| 4,309,022 | 1/1982 | Reinicke et al. | 251/61.4 |
| 4,372,333 | 2/1983 | Goans | 137/1 |
| 4,899,021 | 2/1990 | Daniel | 200/43.16 X |

FOREIGN PATENT DOCUMENTS

| | | | |
|---|---|---|---|
| 604640 | 9/1960 | Canada . | |
| 282423 | 4/1928 | United Kingdom | 200/43.13 |

*Primary Examiner*—Glenn T. Barrett
*Attorney, Agent, or Firm*—Claude F. White

[57] ABSTRACT

A switch actuating assembly supports and actuates a limit switch of the ball and roller type. The assembly includes a housing, a plunger movably positioned within the housing, and an end cap which closes off one end of the housing. The assembly is adapted to be mounted to a vehicle control panel utilizing conventional mounting hardware. Various ball and roller type limit switches are interchangeable with the housing body. The plunger is movable between a first detent position with the limit switch activated and a second spring loaded position with the limit switch deactivated.

13 Claims, 3 Drawing Sheets

SWITCH ACTUATING ASSEMBLY

TECHNICAL FIELD

This invention relates generally to a switch actuating assembly and more particularly to such an assembly which supports a ball and roller type limit switch on a control panel of a vehicle and actuates the switch in a push-pull type function.

BACKGROUND ART

A plurality of operational functions of heavy duty work vehicles are controllable by electrical switches mounted on a control panel in the operator's station of the vehicle. However, because such work vehicles operate in harsh environments and are subject to severe shocks, vibrations, and moisture, conventional industrial "push-pull" type control panel switches have a very short life in such environments.

One type of switch operating mechanism is disclosed in U.S. Pat. No. 3,244,015, issued on Jul. 10, 1964, to T. Parris, Jr. In this patent, axial movement of an actuator shaft is translated into radial movement, which is then translated or interfaced to a limit switch. The housing in this patent must be customized for a particular application and limit switch. Although this switch operating mechanism may function satisfactory in some specific applications, it does utilize a large number of piece parts. Additionally, this mechanism appears suited for actuating a limit switch off bidirectional mechanical or hydraulic motion, and is not intended for use as an automotive type control panel switch.

The present invention is directed to overcoming one or more of the problems as set forth above.

DISCLOSURE OF THE INVENTION

In one aspect of the present invention, an assembly for supporting and actuating a ball and roller type limit switch includes a housing having a body portion and a neck portion extending outwardly of the body portion, a plunger adapted to fit within the housing, an end cap, and means for securing the end cap to the housing. The body portion has an axial bore which accommodates the plunger, and a radial bore which accommodates a ball and roller type limit switch. The plunger has an actuating portion and a detent means.

Most conventional "push-pull" type industrial control panel switches have a very short operational life when used as control panel switches on heavy duty work vehicles. These "push-pull" type switches and their related support components are generally not designed for use in harsh environments where everyday operating conditions include severe vibrations, shock loads, and dirt and debris.

The subject actuating assembly is rugged, but simple in design and includes a minimum number of piece parts. This provides a long lasting and reliable assembly. The housing of the assembly is adapted to accommodate a multitude of standard limit switches and the plunger is adapted to accommodate a plurality of different switch knobs. The assembly is easily mountable to a vehicle control panel utilizing readily available mounting hardware. Various ball and roller type limit switches are interchangeable with the housing body without changing or altering any other components of the assembly. This feature provides for electromechanical contact interchangeability without expensive modifications of the overall assembly design. The actuating assembly operates in a positive axial direction and acts directly against the limit switch.

BEST MODE FOR CARRYING OUT THE INVENTION

Figure 1:
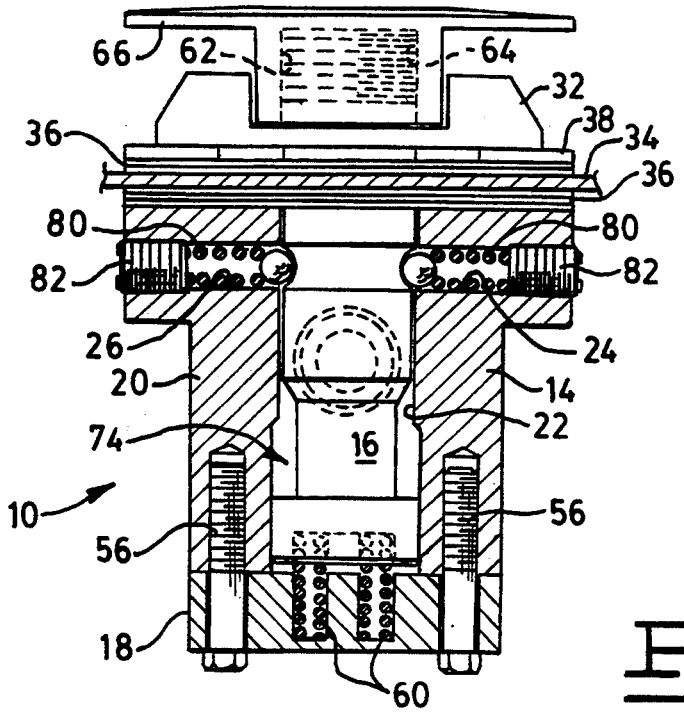
FIG. 1 is a diagrammatic sectional view of the subject switch actuating assembly with the assembly in the switch engaged position.

With reference to the drawings, a switch actuating assembly 10 for supporting and actuating a ball or roller type limit switch 12 includes a housing 14, a plunger 16, and an end cap 18. The housing 14 has a body portion 20 which defines a first axial throughbore 22 and first and second radial bores 24,26 which extend into the axial throughbore 22. The housing 14 also has a neck portion 28 which extends axially outwardly of the body portion 20. The neck portion 28 preferably has an exterior threaded portion 30 which is adapted to receive a threaded retainer 32. The retainer 32 is adapted to releasably connect the switch actuating assembly 10 to a vehicle control panel 34, firewall, or other suitable devices. A plurality of gaskets 36 on each side of the control panel 34 insulate and seal the assembly 10 against the control panel 34. A washer 38, either separate or in conjunction with the retainer 32, spreads the holding force against the gaskets 36 and the control panel 34.

The plunger 16 has first and second end portions 40,42, a middle portion 44, and an actuating portion 46. The middle portion 44 defines a detent means 48, such as a circumferential detent groove 50, and the second end portion 42 defines a first circular cavity, or counterbore 52. The plunger 16 is adapted to fit within the throughbore 22 and is held therein by the end cap 18. The end cap 18 is connected to the housing 14 by releasable securing means 54, such as threaded fasteners 56. The end cap 18 defines a second circular cavity or counterbore 58 which aligns substantially with the first counterbore 52 in the second end portion 42 of the plunger 16. One or more coil springs 60 are positioned within the first and second counterbores 52,58 and assist in moving the plunger 16 within the first axial throughbore 22. The first end portion 40 is preferably provided with threads 62 which mate with similar threads 64 of a switch knob 66.

The body portion 20 of the housing 14 further defines a third radial bore 68 which extends into the first axial throughbore 22. The third radial bore 68 is preferably provided with threads 70 which are adapted to receive a threaded portion 72 of the limit switch 12. The switch knob 66 is used to move the plunger 16 between a first position 74 at which the limit switch 12 actuated and a second position 76 at which the limit switch 12 is deactivated. As the plunger 16 moves from the second position 76 to the first position 74, the actuating portion 46 is adapted to actuate the limit switch 12.

Figure 2:
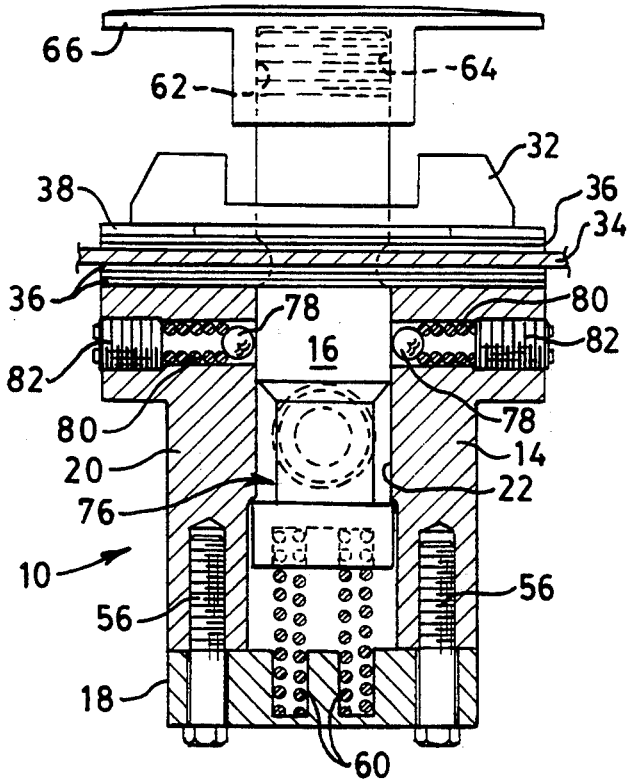
FIG. 2 is a diagrammatic sectional view, similar to FIG. 1, with the actuating assembly in the switch disengaged position.
Figure 5:
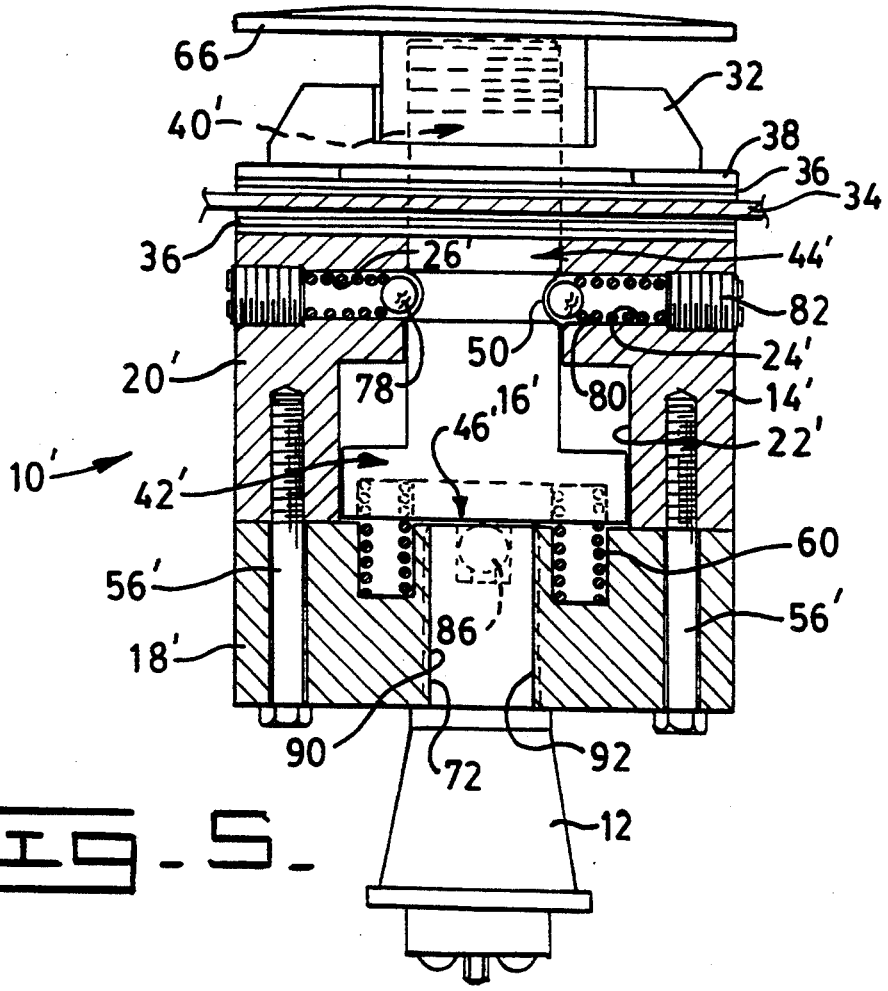
FIG. 5 is a diagrammatic sectional view of an alternate embodiment of the subject invention.

With particular reference to FIGS. 1, 2, and 5, a detent ball 78, a spring 80, and a retaining plug 82 is positioned within each of the first and second radial bores 24,26. The retaining plugs 82 are adapted to apply a compressive force to the springs 80 which moves the detent balls 78 into the detent groove 50 with the plunger 16 in the first position 74. The detent balls 78 are displaced from the detent groove 50 when the plunger 16 is moved to the second position 76.

Figure 3:
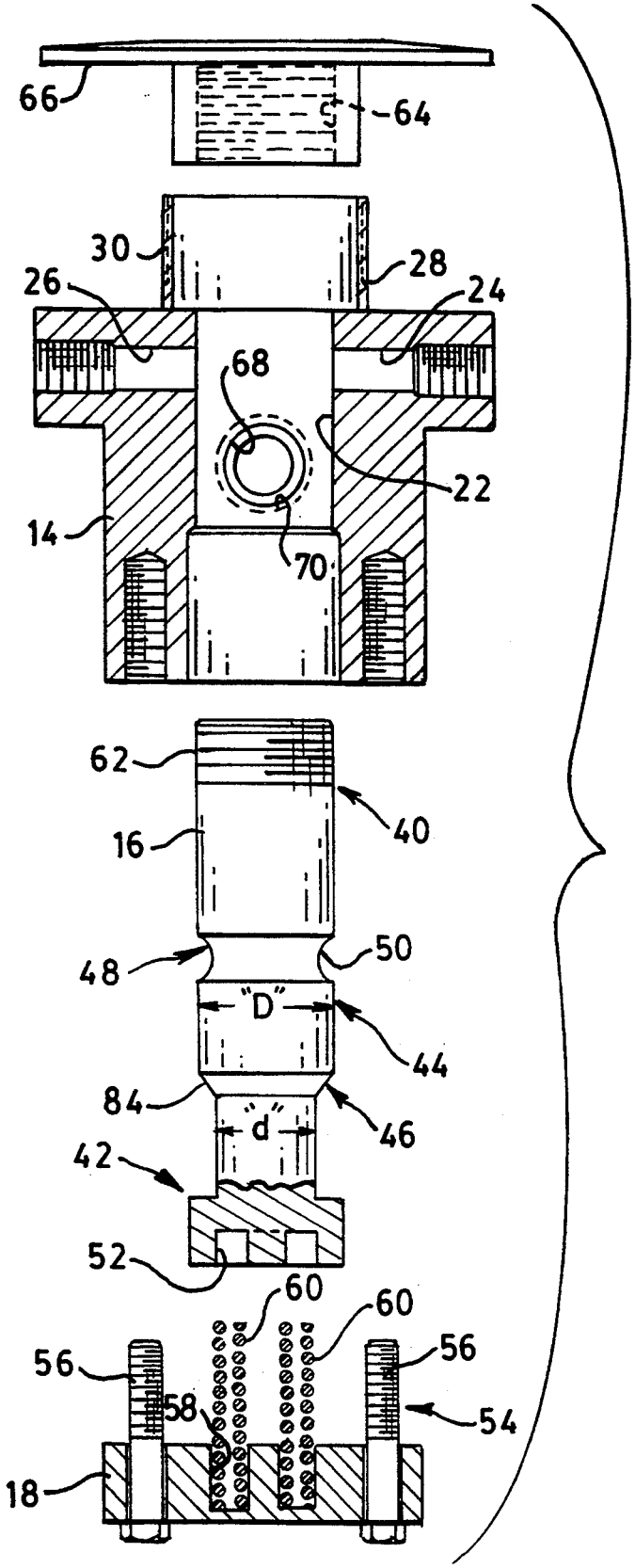
FIG. 3 is a diagrammatic exploded view of the subject switch actuating assembly.
Figure 4:
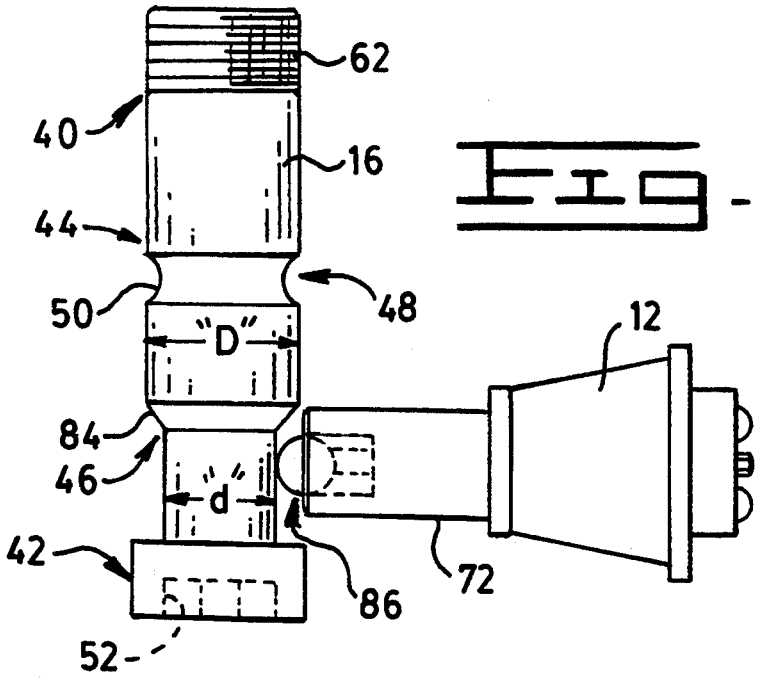
FIG. 4 is a diagrammatic front elevational view of the plunger of the subject invention and a limit switch used with the invention.

With particular reference to FIGS. 3 and 4, the middle portion 44 of the plunger 16 has a first preselected diameter "D" and the actuating portion 46 includes a section having a second smaller diameter "d". A tapered section 84 connects the middle portion 44 to the smaller diameter section 84. The tapered section 84 initially contacts a ball 86 of the limit switch 12 when the plunger 16 is moved from the second position 76 to the first position 74.

With particular reference to FIG. 5, an alternate embodiment of a switch actuating assembly is shown. In this embodiment, identical components are identified by identical reference characters, and similar but different components are identified by similar reference characters with a prime symbol. This actuating assembly 10' includes an end cap 18' which defines a second axial throughbore 90, having threads 92. The threaded portion 72 of the limit switch 12 mates with the threads 92 for receiving and supporting the limit switch 12. The actuating portion 46' of the plunger 16' is substantially coincidental with the first end portion 40'.

Industrial Applicability

With reference to the drawings, the subject switch actuating assembly 10 is particularly useful for mounting and actuating ball or roller type limit switches 12. The assembly 10 can accommodate a plurality of different readily available limit switches. These limit switches can be used to operate various electrically actuated vehicle functions and the subject switch actuating assembly 10 is adapted to mount the limit switches to the control panel of a work vehicle. The assembly 10 is of rugged construction to support the limit switch 12 and can withstand high levels of vibration and shock loads. A "push-pull" panel switch easily operates the plunger 16 of the assembly 10 to activate or de-activate the limit switch 12. Various types of readily available switch knobs 66 can be easily connected to the plunger 16. A detent means 48 holds the plunger 16 in the switch activated position 74, and one or more springs hold the plunger 16 in the switch de-activated position 76.

Other aspects, objects and advantages of this invention can be obtained from a study of the drawings, the disclosure, and the appended claims.

We claim:

1. An assembly for supporting and actuating a ball and roller type limit switch, comprising:

a housing having a body portion, said body portion defining a first axial throughbore and first and second radial bores extending into said axial throughbore, and a neck portion extending outwardly of said body portion;

a plunger having first and second end portions, a middle portion, and an actuating portion, said middle portion defining a detent mechanism and said second end portion defining a first cavity, said plunger being adapted to fit within said throughbore;

an end cap defining a second cavity;

means for releasably securing said end cap to said housing; and said body portion of said housing defining a third radial bore, said third radial bore being adapted to receive and support said limit switch.

2. An assembly, as set forth in claim 1, wherein said actuating portion of said plunger is adapted to actuate said limit switch.

3. An assembly, as set forth in claim 1, including a detent ball, a spring, and a retaining plug positioned in each of said first and second radial bores, said retaining plugs being adapted to apply a compressive force to said springs.

4. An assembly, as set forth in claim 3, wherein said detent balls are positionable in said detent means in a first position of said plunger and are displaced from said detent means in a second position of said plunger.

5. An assembly, as set forth in claim 1, wherein said plunger is movable between a first position at which said limit switch is actuated and a second position at which said limit switch is de-activated.

6. An assembly, as set forth in claim 1, wherein said middle portion has a first diameter "D" and said actuating portion of said plunger includes a section having a second smaller diameter "d" and a tapered section connecting the middle portion to said smaller diameter section.

7. An assembly, as set forth in claim 1, including a switch knob adapted to be connected to said first end portion of said plunger.

8. An assembly, as set forth in claim 1, including a retainer adapted to be connected to said neck portion of said housing.

9. An assembly, as set forth in claim 1, wherein said end cap defines a second axial throughbore, said second axial throughbore being adapted to receive and support said limit switch.

10. An assembly, as set forth in claim 9, wherein said actuating portion is substantially coincidental with said first end portion.

11. A switch actuating assembly for supporting and actuating a ball and roller type limit switch, said assembly being releasably connectable to a control panel, said assembly comprising:

a housing having a body portion and a neck portion extending axially outwardly of said body portion, said body portion defining a first axial throughbore, and first, second, and third radial bores extending into said axial throughbore;

a plunger having first and second end portions, a middle portion, and actuating portion, said middle portion defining a circumferential detent groove, and said second end portion defining a first cavity, said plunger being adapted to fit within said axial throughbore;

an end cap defining a second cavity;

means for releasably securing said end cap to said housing;

a first spring adapted to be positioned within said first and second cavities;

second and third springs positioned within said first and second radial bores respectively, and first and second detent balls positioned within said first and second radial bores respectively; and a limit switch adapted to be positioned and supported within said third radial bore.

12. A switch actuating assembly, as set forth in claim 11, including a retainer, said retainer being adapted to releasably connect said neck portion of said housing to said control panel.

13. An assembly for supporting and actuating a ball and roller type limit switch, comprising:

a housing having a body portion, said body portion defining a first axial throughbore and first and second radial bores extending into said axial throughbore, and a neck portion extending outwardly of said body portion;

a plunger having first and second end portions, a middle portion, and an actuating portion, said middle portion defining a detent mechanism and said second end portion defining a first cavity, said plunger being adapted to fit within said throughbore;

an end cap defining a second cavity;

means for releasably securing said end cap to said housing; and including a spring adapted to be positioned within said first and second cavities.

* * * * *